US009044946B2

(12) United States Patent
Kohda et al.

(10) Patent No.: US 9,044,946 B2
(45) Date of Patent: Jun. 2, 2015

(54) DROPLET DISCHARGE HEAD AND IMAGE FORMING APPARATUS INCLUDING SAME

(71) Applicants: Tomohiko Kohda, Ibaraki (JP); Noriyasu Takeuchi, Kanagawa (JP); Takahiro Yoshida, Ibaraki (JP); Ryohta Matsufuji, Kanagawa (JP)

(72) Inventors: Tomohiko Kohda, Ibaraki (JP); Noriyasu Takeuchi, Kanagawa (JP); Takahiro Yoshida, Ibaraki (JP); Ryohta Matsufuji, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/471,174

(22) Filed: Aug. 28, 2014

(65) Prior Publication Data

US 2015/0077469 A1 Mar. 19, 2015

(30) Foreign Application Priority Data

Sep. 13, 2013 (JP) ..... 2013-190909
Mar. 14, 2014 (JP) ..... 2014-052538
Jun. 6, 2014 (JP) ..... 2014-117622

(51) Int. Cl.

| | |
|---|---|
| ***B41J 2/045*** | (2006.01) |
| ***B41J 2/145*** | (2006.01) |
| ***B41J 2/055*** | (2006.01) |
| ***B41J 2/14*** | (2006.01) |

(52) U.S. Cl.
CPC *B41J 2/145* (2013.01); *B41J 2/055* (2013.01); *B41J 2/14209* (2013.01)

(58) Field of Classification Search
CPC ..... B41J 2/055; B41J 2/14209; B41J 2/1433; B41J 2/14024; B41J 2/1623; B41J 2/17563
USPC ..... 347/68, 70, 71, 92–94
See application file for complete search history.

(56) References Cited

U.S. PATENT DOCUMENTS

| | | | | |
|---|---|---|---|---|
| 7,052,118 | B2 * | 5/2006 | Akahane | 347/68 |
| 2006/0007272 | A1 | 1/2006 | Ogata et al. | |
| 2008/0117262 | A1 | 5/2008 | Mori et al. | |
| 2009/0102907 | A1 | 4/2009 | Yamanaka et al. | |
| 2010/0328400 | A1 | 12/2010 | Koda et al. | |
| 2010/0328409 | A1 | 12/2010 | Matsufuji et al. | |
| 2012/0236080 | A1 | 9/2012 | Yoshida et al. | |
| 2013/0242012 | A1 | 9/2013 | Hayashi et al. | |
| 2014/0009544 | A1 | 1/2014 | Koda | |

FOREIGN PATENT DOCUMENTS

| | | |
|---|---|---|
| JP | 2006-347036 | 12/2006 |
| JP | 2007-008108 | 1/2007 |
| JP | 2007-230214 | 9/2007 |

(Continued)

*Primary Examiner* — Juanita D Jackson
(74) *Attorney, Agent, or Firm* — Cooper & Dunham LLP

(57) ABSTRACT

A droplet discharge head includes a nozzle substrate containing a plurality of nozzles to discharge droplets; a channel substrate to form a plurality of individual liquid chambers to which the plurality of nozzles communicate; a common liquid chamber member, comprising a wall, to form a common liquid chamber to supply liquid to the plurality of individual liquid chambers; a wall member to form a deformable damper area on a part of the wall of the common liquid chamber member, in which the channel substrate and the common liquid chamber member are laminated together with the wall member sandwiched in between, and the channel substrate includes a concave-shaped damper chamber corresponding to the damper area; and a plurality of support pillars disposed on a concave-shaped bottom of the damper chamber, the support pillar connecting to the wall.

10 Claims, 12 Drawing Sheets

(56) References Cited

FOREIGN PATENT DOCUMENTS

| | | |
|---|---|---|
| JP | 2007-253537 | 10/2007 |
| JP | 2007-307774 | 11/2007 |
| JP | 2008-080797 | 4/2008 |
| JP | 2009-056786 | 3/2009 |
| JP | 2010-188547 | 9/2010 |
| JP | 2012-101365 | 5/2012 |

* cited by examiner

DROPLET DISCHARGE HEAD AND IMAGE FORMING APPARATUS INCLUDING SAME

CROSS-REFERENCE TO RELATED APPLICATIONS

The present application claims priority pursuant to 35 U.S.C. §119(a) from Japanese patent application numbers 2013-190909, 2014-052538, and 2014-117622, filed on Sep. 13, 2013, Mar. 14, 2014, and Jun. 6, 2014, respectively, the entire disclosures of which are incorporated by reference herein.

BACKGROUND

1. Technical Field

Exemplary embodiments of the present invention relate to a droplet discharge head and an image forming apparatus including the droplet discharge head.

2. Related Art

Among various types of image forming apparatuses including a printer, a facsimile machine, a copier, a plotter, and a multifunction apparatus combining several capabilities of the above devices, an inkjet recording apparatus has been known as an image forming apparatus using a liquid discharging recording method, in which a recording head formed of a droplet discharge head (droplet discharge head) to discharge droplets is employed.

In the droplet discharge head, when an individual liquid chamber is compressed to discharge the droplet, fluctuation of the pressure generated in the individual liquid chamber is propagated as a pressure wave to a common liquid chamber (or a common channel) to supply liquid to the plurality of individual liquid chambers. When the pressure wave propagated to the common liquid chamber is inversely propagated to the individual liquid chamber, the pressure in the individual liquid chamber fluctuates so that a meniscus of a nozzle is not controlled, the droplet is not discharged at a predetermined droplet speed in a predetermined droplet amount (or a droplet volume), thereby causing a misfiring of the droplet. In addition, when the pressure wave propagated to the common liquid chamber further propagates to the adjacent individual liquid chamber, the propagation causes a reciprocal interference to adversely affect the liquid itself, thereby inducing a leak or discharge of droplet from the unintended nozzle and unstable discharge.

One approach to cope with the above problem is to provide a deformable damper area in a part of the wall member that forms a wall of the common liquid chamber, and a damper chamber formed on a channel substrate and opposite the common liquid chamber, which is exposed to external air via the damper area from an edge surface of the channel substrate.

However, when the damper chamber is formed on the channel substrate, part of the damper chamber becomes hollow, compromising the rigidity of the channel substrate. In particular, when the wall member and the common liquid chamber member to form the common liquid chamber are laminated together with the channel substrate, portions opposite the hollow portion of the damper chamber are not laminated. As a result, when pressure of vibration due to droplet discharge is propagated, vibration is generated and is propagated to the liquid in the channel substrate, thereby causing fluctuations of the droplet discharge property.

SUMMARY

In one embodiment of the disclosure, there is provided a droplet discharge head including a nozzle substrate containing a plurality of nozzles to discharge droplets; a channel substrate to form a plurality of individual liquid chambers to which the plurality of nozzles communicate; a common liquid chamber member, comprising a wall, to form a common liquid chamber to supply liquid to the plurality of individual liquid chambers; a wall member to form a deformable damper area on a part of the wall of the common liquid chamber member, in which the channel substrate and the common liquid chamber member are laminated together with the wall member sandwiched in between, and the channel substrate includes a concave-shaped damper chamber corresponding to the damper area; and a plurality of support pillars disposed on a concave-shaped bottom of the damper chamber, the support pillar connecting to the wall.

In one embodiment of the disclosure, there is provided an image forming apparatus including the above-described droplet discharge head.

These and other objects, features, and advantages of the present invention will become apparent upon consideration of the following description of preferred embodiments of the present invention when taken in conjunction with the accompanying drawings.

DETAILED DESCRIPTION

Figure 1:
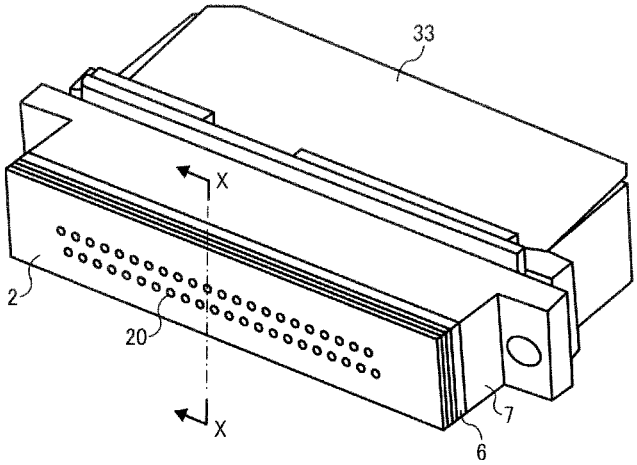
FIG. 1 is a perspective view of a droplet discharge head according to an embodiment of the present invention.
Figure 2:
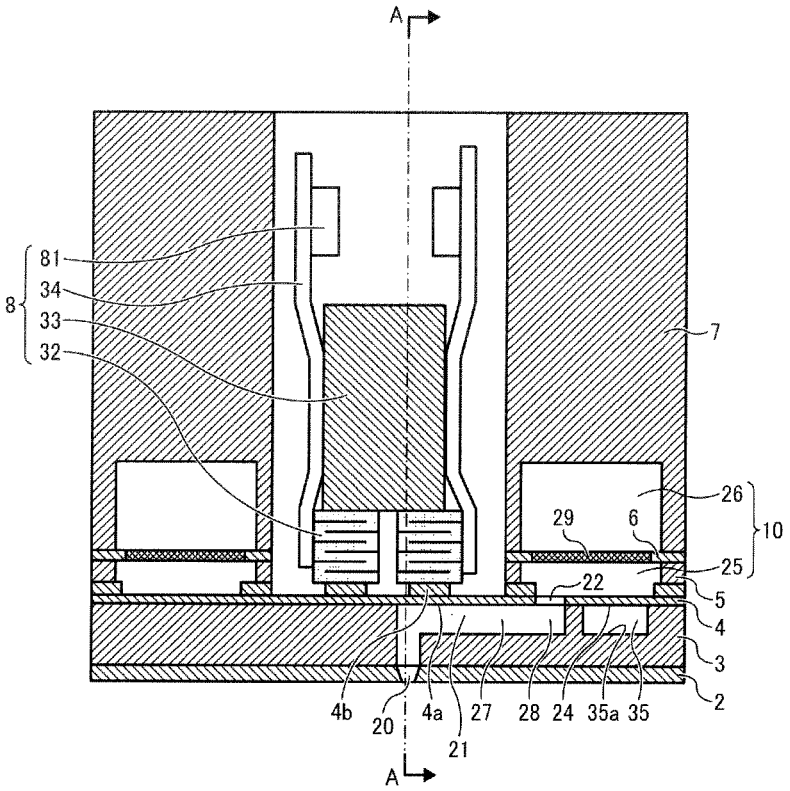
FIG. 2 is a cross-sectional view of the droplet discharge head taken along X-X line in FIG. 1 perpendicular to a nozzle alignment direction.
Figure 3:
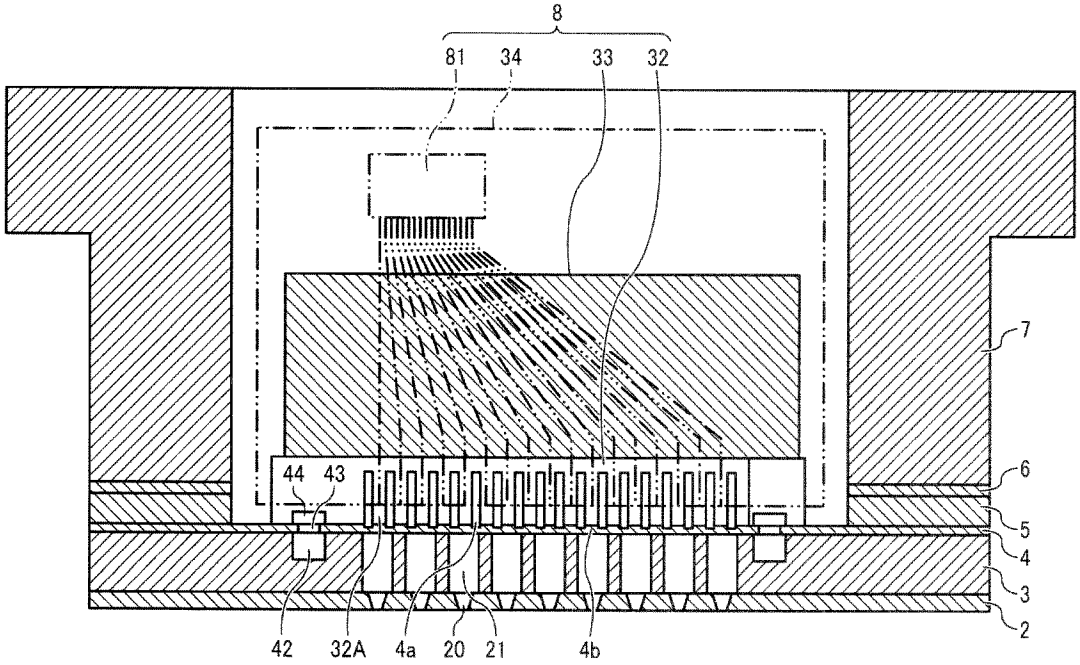
FIG. 3 shows a cross-sectional view taken along A-A line in FIG. 2.

Hereinafter, preferred embodiments of the present invention will now be described with reference to accompanying drawings. An example of a droplet discharge head according to the present invention will be described with reference to FIGS. 1 through 3. FIG. 1 is a perspective view of the droplet discharge head; FIG. 2 is a cross-sectional view of a main part of the droplet discharge head taken along X-X line in FIG. 1; and FIG. 3 is a cross-sectional view of the same along A-A line in FIG. 2.

This droplet discharge head includes a nozzle substrate 2, a channel substrate 3, a diaphragm 4 serving also as a wall, a second common liquid chamber member 5, a filter 6, and a first common liquid chamber member 7, each member is laminated to form a layered structure.

A plurality of nozzles 20 each of which discharges droplets is formed on the nozzle substrate 2 in two staggered rows. The nozzle substrate 2 is formed by press work using stainless steel (herein, SUS 316).

The channel substrate 3 is formed of a pressure chamber 21 being an individual liquid chamber communicating to the nozzle 20; a fluid resistance member 27 communicating to the pressure chamber 21; and a liquid inlet 28 to which the fluid resistance member 27 communicates. The channel substrate 3 is formed by press work using stainless steel (herein, SUS 316). The both sides of the channel substrate 3 are polished substantially flat.

The diaphragm 4 includes a displaceable vibration area 4*a* formed of a part of the wall of the pressure chamber 21. The diaphragm 4 includes a liquid supply channel 22 which approaches a common liquid chamber 25 below a filter 6 and communicates the common liquid chamber 25 below the filter 6 to the liquid inlet 28 of each pressure chamber 21. The diaphragm 4 is formed by nickel casting.

The second common liquid chamber member 5, the filter 6, and the first common liquid chamber member 7 serving also as a frame of the head is sequentially laminated by an adhesive agent on an opposite side of the pressure chamber 21 of the diaphragm 4.

The first common liquid chamber member 7 and the second common liquid chamber member 5 together form a common liquid chamber 10 communicating to each pressure chamber 21. The common liquid chamber 10 is formed of a common liquid chamber 26 above an upstream filter and the common liquid chamber 25 below the downstream filter.

The filter 6 includes a filter area 29 in which multiple filter pores are formed. Foreign particles are caught from the liquid flowing from the common liquid chamber 26 above the filter to the common liquid chamber 25 below the filter.

The first common liquid chamber member 7 forms the common liquid chamber 26 above the filter and includes a liquid supply port, not shown, through which the liquid is supplied from outside. The liquid supply ports are disposed at longitudinal lateral ends of the common liquid chamber 26 above the filter.

A piezoelectric actuator 8 is disposed on a vibration area 4*a* of the diaphragm 4 on a side opposite the pressure chamber 21. The piezoelectric actuator 8 includes a base member 33 and two piezoelectric members 32 jointed each other. Columnar piezoelectric elements or piezoelectric pillars 32A are formed with a pitch half that of the nozzle along two rows of nozzle arrays. Each piezoelectric pillar of the piezoelectric members 32 is connected to a projection 4*b* formed on the vibration area 4*a* of the diaphragm 4 and is supplied with driving signals from a driving IC 81 via a flexible wiring member 34. The driving IC 81 is disposed on the flexible wiring member 34.

The channel substrate 3 and the second common liquid chamber member 5 are laminated together with the diaphragm 4 sandwiched in between.

A part of the diaphragm 4 that forms a wall of the common liquid chamber 25 below the filter is used as a deformable area or a damper area 24; and a damper chamber 35 opposite the common liquid chamber 25 below the filer is formed in the channel substrate 3 with the damper area 24 sandwiched in between.

The damper chamber 35 is exposed to air through an air exposure channel 42 formed in the channel substrate 3, an air exposure hole 43 formed in the diaphragm 4, and an air exposure channel 44 formed in the piezoelectric member 32.

In the present droplet discharge head, when the piezoelectric actuator 8 is driven, the vibration area 4*a* of the diaphragm 4 displaces, the liquid in the pressure chamber 21 is pressed, and the droplet is discharged from the nozzle 20.

Figure 4:
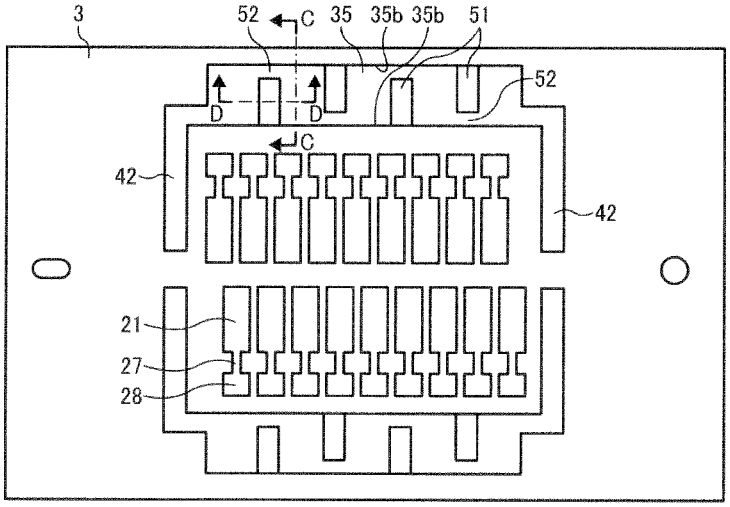
FIG. 4 is a plan view of a channel substrate seen from a diaphragm illustrating a first embodiment of the present invention.
Figure 5:
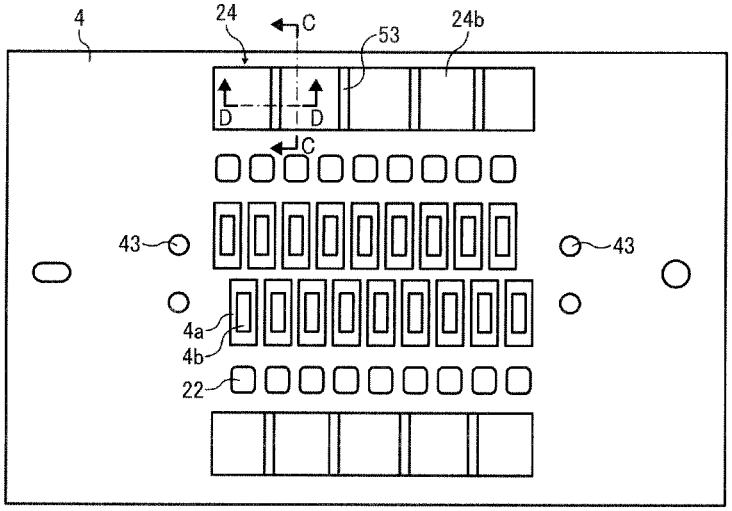
FIG. 5 is a plan view of the diaphragm seen from a second common liquid chamber.
Figure 6:
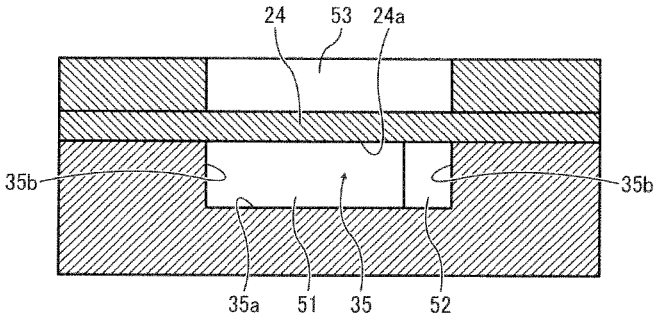
FIG. 6 shows a cross-sectional view taken along C-C line in FIGS. 4 and 5.
Figure 7:
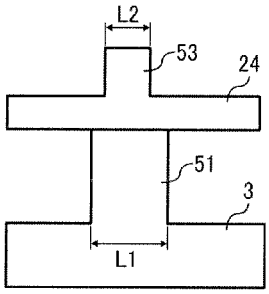
FIG. 7 shows a cross-sectional view taken along D-D line in FIGS. 4 and 5.

Next, a first embodiment according to the present invention will be described with reference to FIGS. 4 through 7. FIG. 4 is a plan view of the channel substrate seen from the diaphragm illustrating the first embodiment of the present invention; FIG. 5 is a plan view of the diaphragm seen from the second common liquid chamber, FIG. 6 shows a cross-sectional view taken along C-C line in FIGS. 4 and 5; and FIG. 7 shows a cross-sectional view taken along D-D line in FIGS. 4 and 5. Hatching of the cross section in FIG. 7 is omitted.

In the present embodiment, the damper chamber 35 having a concave shape is formed to correspond to the damper area 24 of the diaphragm 4 along the nozzle alignment direction. The damper chamber 35 is opposite the common liquid chamber 25 below the filter with the damper area 24 sandwiched in between.

Each of the air exposure channels 42 to expose air inside the damper chamber 35 is disposed at lateral ends in the nozzle alignment direction of the damper chamber 35. The air exposure channel 42 communicates to external air via the air exposure channel 42 of the diaphragm 4 and the air exposure channel 44 of the piezoelectric members 32, so that the damper chamber 35 is exposed to external air.

The damper chamber 35 includes a concave-shaped bottom 35*a*. A wall 51 being a support pillar connected to a wall 24*a* of the damper area 24 is disposed on the bottom 35*a*. In addition, the wall 51 includes other walls 35*b*, 35*b* in the direction perpendicular to the nozzle alignment direction. Between two walls, a channel 52 through which air is communicated is formed. The wall 51 is integrally formed with the wall 35*b*, but the walls 35*b*, 35*b* are discriminably represented for easier understanding from the plan view.

Herein, the term "bottom" means a wall of the damper chamber 35 opposite the wall 24*a* of the damper area 24 and means a wall of the damper chamber 35 positioned at the bottom in the vertical direction of the figure. In addition, the term "support pillar" means a structure such as the wall 51 being a part of the wall that supports the wall 24*a* of the damper area 24. The term "connect (-ed, -ing, -ion)" includes fixing the wall 51 as a support pillar and the wall 24*a* of the damper area 24 with an adhesive agent.

In the present embodiment, a plurality of walls 51 are disposed in the nozzle alignment direction and the channels 52 between adjacent walls 51 are disposed at different positions in the direction perpendicular to the nozzle alignment direction.

Herein, the damper area 24 of the diaphragm 4 includes a plurality of ribs 53 in the nozzle alignment direction to section into a plurality of areas 24*b*. One area 24*b* corresponds to more than two pressure chambers 21.

Accordingly, the walls 51 inside the damper chamber 35 are disposed corresponding to positions of the ribs 53 of the damper area 24.

In the present embodiment, the ribs 53 are integrally formed with the wall 24*a* of the damper area 24; however, the ribs 53 may be formed such that a member on which a rib 53 is formed as a separate member and adhered to the damper area 24.

As illustrated in FIG. 7, a width L1 of the wall 51 inside the damper chamber 35 in the nozzle alignment direction is made larger than a width L2 of the rib 53 in the damper area 24 in the nozzle alignment direction, so that the wall 51 inside the damper chamber 35 is securely opposed to the rib 53 in the damper area 24 even though a positional error occurs in the attachment.

Thus, the wall 51 as a support pillar is disposed on the concave-shaped bottom of the damper chamber 35 in the channel substrate 3, and the wall 51 and the wall of the damper area 24 formed of the diaphragm 4 are connected, so that a large hollow area is reduced and the rigidity of the channel substrate 3 itself increases. Further, because the wall 51 is provided with the channel 52 through which air passes, the damper chamber 35 may be configured to be exposed to external air easily.

In addition, because the walls 51 of the channel substrate 3 are disposed at positions corresponding to positions of the ribs 53 of the diaphragm 4 in the nozzle alignment direction, when the channel substrate 3 and the diaphragm 4 are adhered to each other, the walls 51 can be pressed via the ribs 53 and an area around the damper chamber 35 can be securely pressed, so that the adhesion between the diaphragm 4 and the channel substrate 3 is secured. As a result, the rigidity of the channel substrate 3 is secured reliably.

With this structure, the rigidity of the channel substrate 3 can be prevented from decreasing even though the damper chamber is provided, and a more stable droplet discharge can be obtained.

In addition, because the channels 52 of the adjacent walls 51 are disposed at different positions in the direction perpendicular to the nozzle alignment direction, portions with lower rigidity where the channels 52 are disposed along the nozzle alignment direction do not exist locally, so that the rigidity of the channel substrate 3 is prevented from decreasing.

If the damper chamber is sectioned with partition walls into multiple small damper chambers, air exposing channels need to be provided for each sectioned damper chamber. By contrast, in the present embodiment, the channel 52 through which air passes is provided to the wall 51, so that the wall 51 is not a partition wall. Instead, air passes through inside the damper chamber 35, so that a structure to expose the damper chamber 35 to external air can be made simple.

Figure 8:
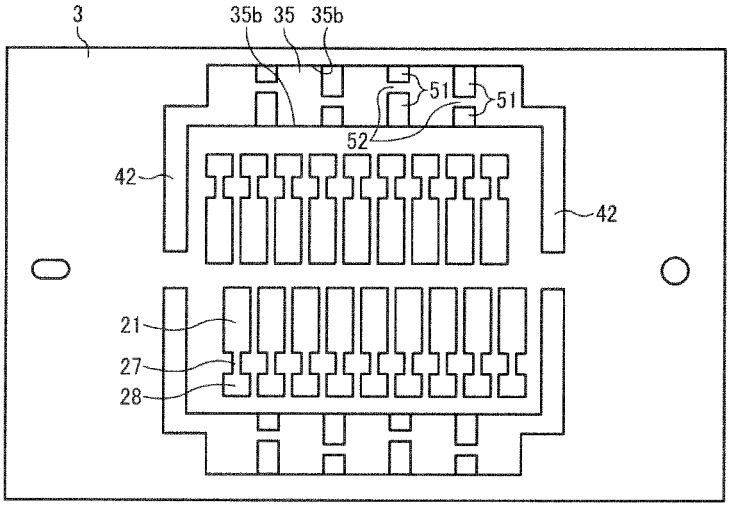
FIG. 8 is a plan view of the channel substrate seen from the diaphragm illustrating a second embodiment of the present invention.

Next, referring to FIG. 8, a second embodiment of the present invention will be described. FIG. 8 is a plan view of the channel substrate seen from the diaphragm illustrating the second embodiment of the present invention.

In the second embodiment, the walls 51 are connected to both walls 35*b*, 35*b* of the damper chamber 35 in the direction perpendicular to the nozzle alignment direction and the channel 52 is formed in the middle of the walls 51. Herein, the channels 52 of the adjacent walls 51 position at different positions in the direction perpendicular to the nozzle alignment direction.

With this configuration, the same effect as that of the first embodiment can be obtained. That is, the rigidity of the channel substrate 3 can be prevented from decreasing even though the damper chamber is provided, and a more stable droplet discharge can be obtained.

The ribs 53 and the walls 51 are adhered such that the ribs 53 are supported by the walls 51 of the both walls 35*b*, 35*b* at both lateral sides, so that the ribs 53 and the walls 51 are stably adhered.

Figure 9:
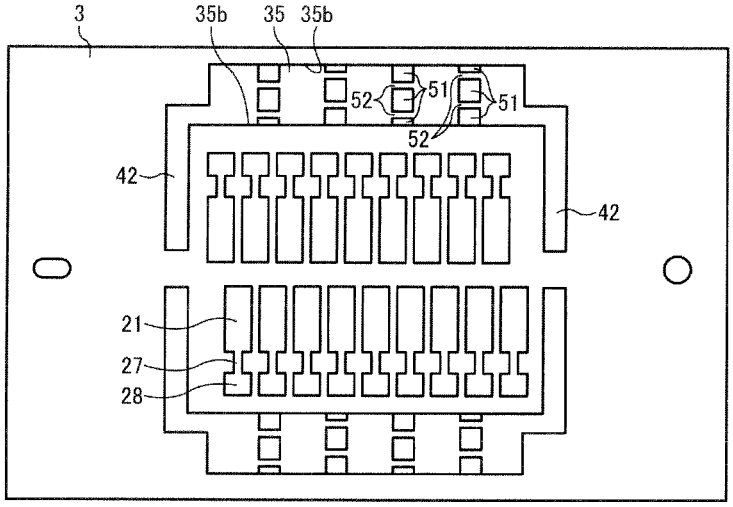
FIG. 9 is a plan view of the channel substrate seen from the diaphragm illustrating a third embodiment of the present invention.

Next, referring to FIG. 9, a third embodiment of the present invention will be described. FIG. 9 is a plan view of the channel substrate seen from the diaphragm illustrating the third embodiment of the present invention.

In the third embodiment, the walls 51 are connected to both walls 35*b*, 35*b* of the damper chamber 35 in the direction perpendicular to the nozzle alignment direction and the channels 52 are formed at multiple positions in the middle of the walls 51. Herein, the channels 52 of the adjacent walls 51 position at different positions in the direction perpendicular to the nozzle alignment direction.

With this configuration, the same effect as that of the first embodiment can be obtained, that is, stable droplet discharge can be obtained by preventing the rigidity of the channel substrate from decreasing even though the damper chamber is disposed on the channel substrate. In addition, because an area over which the wall 51 presses the damper area 24 is reduced, compliance of the damper area 24 can be greater.

In the connection with the damper area 24 using the adhesive agent, in the event that the adhesive agent leaks into one of the channels 52 and the channel 52 is blocked, the air can pass through the other channel 52.

Figure 10:
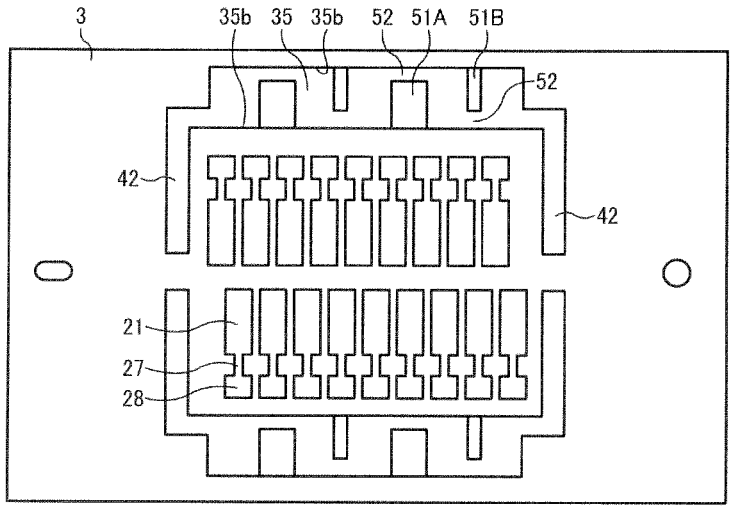
FIG. 10 is a plan view of the channel substrate seen from the diaphragm illustrating a fourth embodiment of the present invention.

Next, referring to FIG. 10, a fourth embodiment of the present invention will be described. FIG. 10 is a plan view of the channel substrate seen from the diaphragm illustrating the fourth embodiment of the present invention.

In the present fourth embodiment, a first wall 51A and a second wall 51B having a width in the nozzle alignment direction different from that of the wall 51A are alternately disposed.

With this configuration, the same effect as that of the first embodiment can be obtained. In addition, because an area where the walls 51A, 51B fix the damper area 24 can be changed, compliance of the damper area 24 can be increased. In addition, by making the area of the walls greater, the rigidity of the channel substrate can be prevented from decreasing.

Figure 11:
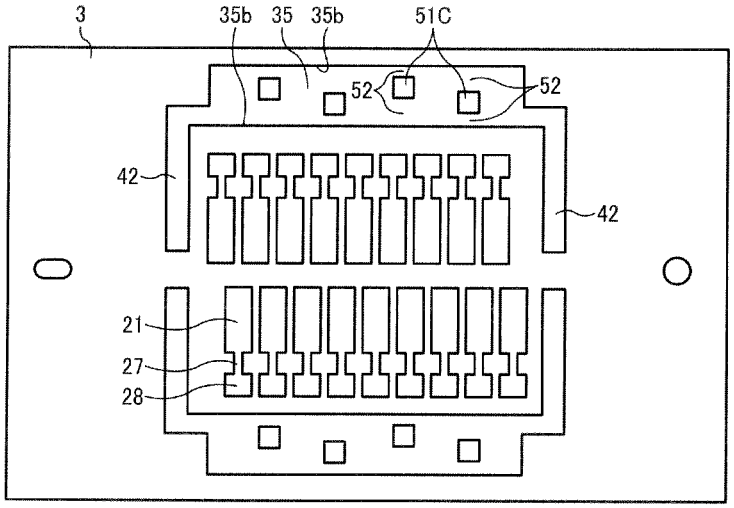
FIG. 11 is a plan view of the channel substrate seen from the diaphragm illustrating a fifth embodiment of the present invention.

Next, referring to FIG. 11, a fifth embodiment of the present invention will be described. FIG. 11 is a plan view of the channel substrate seen from the diaphragm illustrating the fifth embodiment of the present invention.

In the present embodiment, support pillars 51C are disposed and portions between the support pillars 51C and the walls 35*b*, 35*b* of the damper chamber 35 in the direction perpendicular to the nozzle alignment direction are set as the channels 52.

Specifically, in each embodiment as described above, the support pillar is formed integrally with the wall of the damper chamber. Alternatively, however, the support pillar may be formed not connecting with the wall of the damper chamber as in the fifth embodiment.

With such a configuration, an area that the channels 52 occupy increases and the area extends along the nozzle alignment direction, but no problem will occur depending on the rigidity of the material that forms the channel substrate 3.

For example, in each of the embodiments described heretofore, the channel substrate 3 is formed of one substrate alone; however, the channel substrate 3 can be formed of three substrates laminated. In this case, the bottom of the damper chamber may be formed of one substrate and the support pillar may be formed by laminating two substrates.

Figure 12:
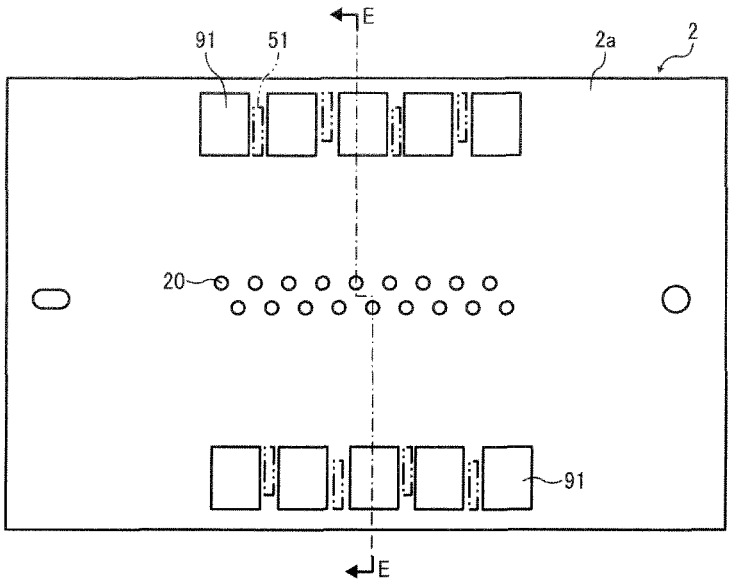
FIG. 12 is a plan view of the droplet discharge head seen from a nozzle substrate according to a sixth embodiment of the present invention.
Figure 13:
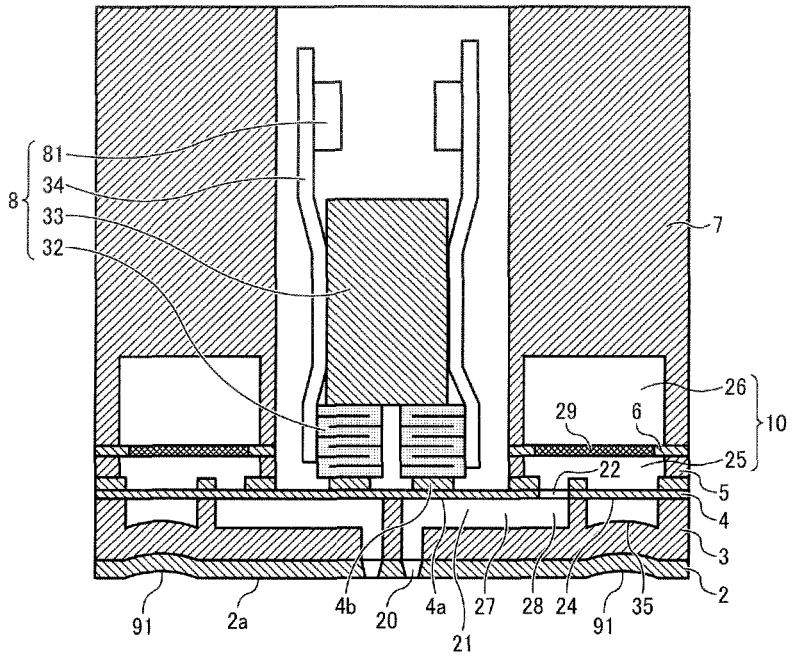
FIG. 13 is a cross-sectional view illustrating the droplet discharge head in a direction perpendicular to a nozzle alignment direction along E-E line in FIG. 13.

Next, a sixth embodiment according to the present invention will be described with reference to FIGS. 12 and 13. FIG. 12 is a plan view of the droplet discharge head seen from the nozzle substrate according to the sixth embodiment of the present invention. FIG. 13 is a cross-sectional view illustrating the droplet discharge head in the direction perpendicular to the nozzle alignment direction along E-E line in FIG. 12.

In the sixth embodiment, similar to the first embodiment, the walls 51 as support pillars are disposed inside the damper chamber 35 in the nozzle alignment direction.

Concave portions 91 are disposed on a side of the nozzle surface 2*a* of the nozzle substrate 2 between the walls 51, 51 and in an area corresponding to an area between the walls 51 and the both lateral side walls of the damper chamber 35. In this case, a plurality of concave portions 91 are disposed in the nozzle alignment direction.

Specifically, by applying the pressure when the nozzle substrate 2, the channel substrate 3, and the diaphragm 4 are laminated together, the concave portions 91 are formed in areas where the walls 51 and the channel substrate 3 do not exist in the damper chamber 35. The size and degree of concavity of the concave portions 91 are determined by joining pressure and the pitch of the walls 51. In addition, the concave portions 91 formed by the joining pressure is smoothly curved toward the bottom as illustrated in FIG. 13.

As such, by forming the concave portions 91 at areas corresponding to the areas between support pillars of the damper chamber 35, the concave portions 91 are formed at positions separated from the nozzles 20. With this structure, when the nozzle surface 2*a* is wiped by a wiper member, ink in the nozzle surface 2*a* can be led to the side of the concave portions 91, thereby reducing the residual ink in the vicinity of the nozzles 20 and preventing the droplet discharge from bending.

Specifically, when the thin layer members such as the nozzle substrate 2 and the channel substrate 3 are laminated to form a head, the nozzle surface (or the droplet discharge surface) 2*a* of the nozzle substrate 2 minutely deforms, and the waste ink tends to remain at the concave portion when wiped by the wiper member. At this time, when the ink remains at the concave portion in the vicinity of the nozzle, a phenomenon that the discharged droplet is bending tends to occur.

By contrast, in the present embodiment, when the nozzle surface is wiped by the wiper member, because rigidity in the vicinity of the nozzle is high and the concave portion becomes relatively weak, the residual ink in the vicinity of the nozzle can be easily wiped.

Further, because the concave portions 91 of the present embodiment are curved and not grooved, by increasing the wiping pressure of the wiper, the ink remaining in the concave portions 91 can be removed. As a result, for example, the surface near the nozzle surface is wiped, and if the ink remains at the nozzle surface, wiping pressure is increased so that the entire nozzle substrate can be wipe optionally.

Figure 14:
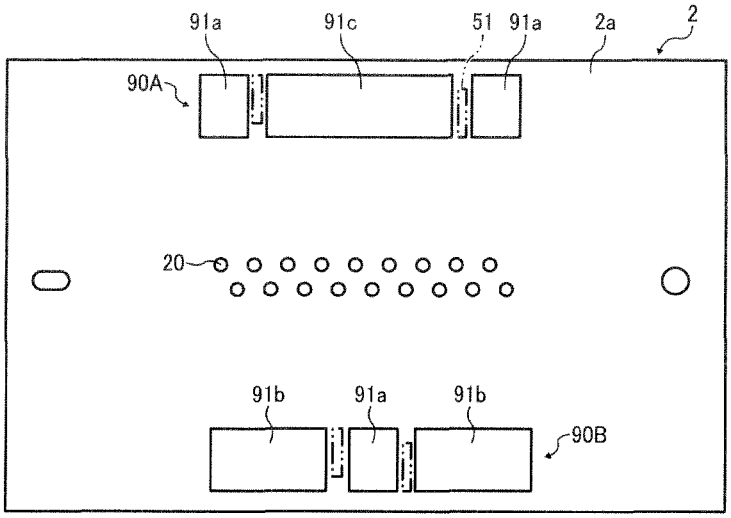
FIG. 14 is a plan view of the droplet discharge head seen from the nozzle substrate according to a seventh embodiment of the present invention.

Next, referring to FIG. 14, a seventh embodiment of the present invention will be described. FIG. 14 is a plan view of the droplet discharge head seen from the nozzle substrate according to the seventh embodiment of the present invention.

In the present seventh embodiment, concave portion rows 90A, 90B are disposed in the both end portions, respectively, in the direction perpendicular to the nozzle alignment direction, relative to the two rows of nozzle rows. Concave portion rows 90A and 90B are formed of concave portions 91*a* to 91*c*, each of which has a different width in the nozzle alignment direction, and each of the concave portion row 90A and the concave portion row 90B has the concave portions 91*a* to 91*c* in different order and combination.

Such concave portions 91 (91*a* to 91*c*) each having a different size can be formed by changing an interval between the adjacent walls 51 inside the damper chamber 35 and changing the depth. As such, the concave portions 91*a* to 91*c* of the concave portion rows 90A and 90B are unevenly disposed and the size and the depth of the concave portions 91*a* to 91*c* are different, so that the load on the wiper member can be distributed evenly. By contrast, when the same concave portions are regularly disposed, the pressure applied to the wiper member becomes uniform at a constant cycle, so that a higher load portion and a less load portion locally appear.

Figure 15:
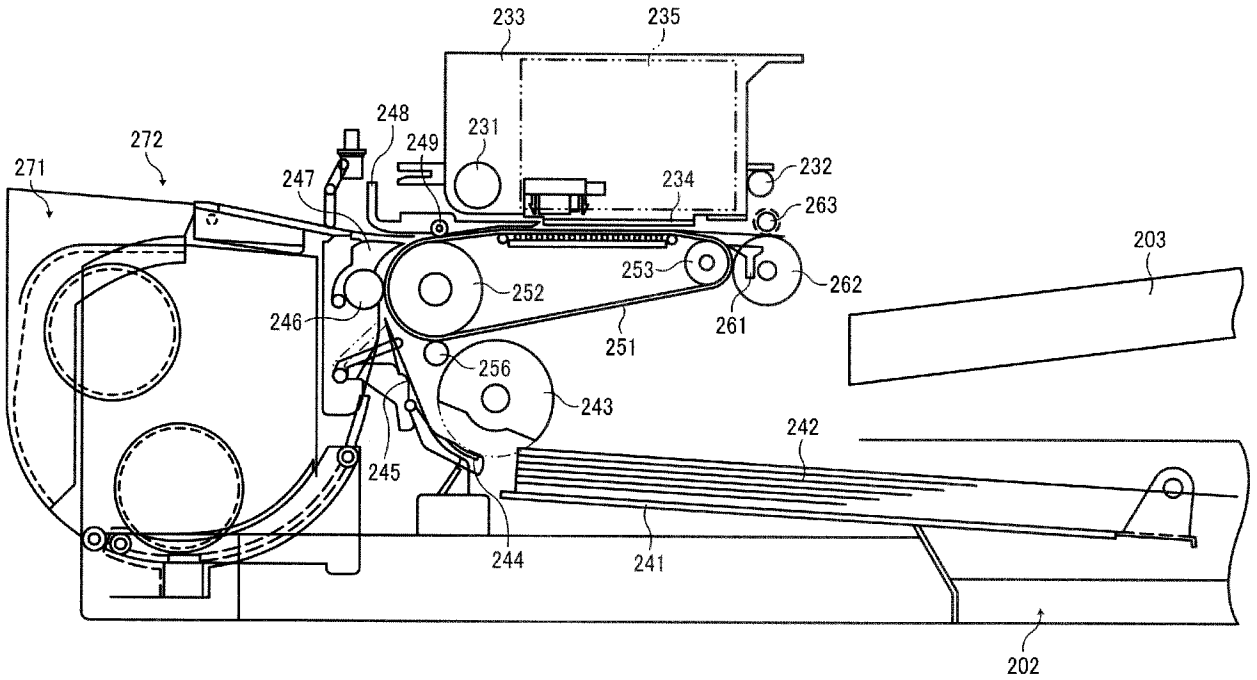
FIG. 15 is an explanatory side view of an image forming apparatus illustrating an overall configuration thereof according to the present invention.
Figure 16:
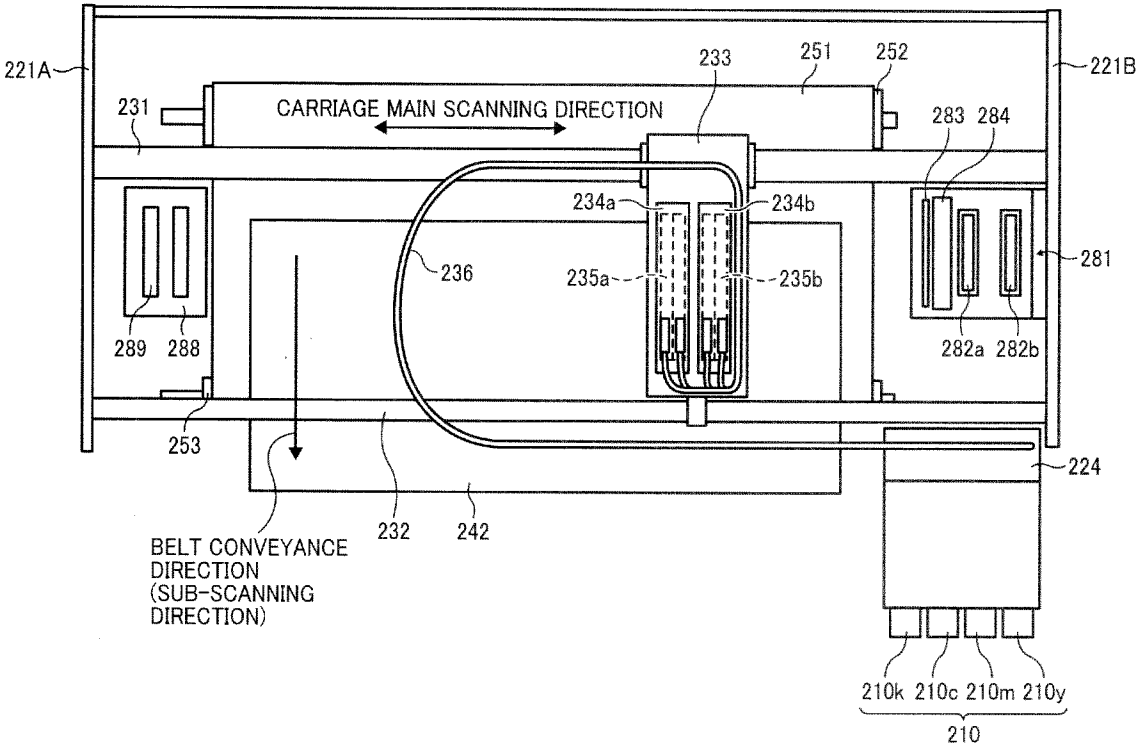
FIG. 16 is a plan view illustrating a main part of the image forming apparatus.

Next, an example of an image forming apparatus according to the present invention will be described with reference to FIGS. 15 and 16. FIG. 15 is a side view of the image forming apparatus illustrating a mechanical structure thereof, and FIG. 16 is a plan view illustrating the main part of the image forming apparatus of FIG. 15.

This image forming apparatus is a serial-type image forming apparatus, including a main and auxiliary guide rods 231, 232 laterally held by side plates 221A, 221B, and a carriage 233 which is slidably held by the guide rods 231, 232 to be movable in a main scanning direction. The carriage 233 is connected to a main scanning motor, not shown, via a timing belt and moves to scan in the main scanning direction of the carriage as indicated by an arrow driven by the main scanning motor, not shown.

Recording heads 234*a*. 234*b*, mounted on the carriage 233 include bifurcated recording heads 234*a* and 234*b* (collectively referred to as the recording heads 234. The recording heads 234 are formed of liquid discharging heads to discharge ink droplets of yellow (Y), cyan (C), magenta (M), and black (K) colors, respectively. The recording heads 234 include nozzle arrays formed of a plurality of nozzles arranged in a sub-scanning direction perpendicular to the main scanning direction, with the ink droplet discharging direction oriented downward.

The recording heads 234 each include two nozzle arrays. One of the nozzle arrays of the recording head 234*a* discharges droplets of black (K) and the other discharges droplets of cyan (C) ink. One of nozzle arrays of the other recording head 234*b* discharges droplets of magenta (M) and the other discharges droplets of yellow (Y), respectively. Herein, four colors of droplets are discharged using two heads, but it can be configured such that one head includes four nozzle arrays and four colors of droplets can be discharged from each head.

The carriage 233 includes sub tanks 235, which supply ink of respective colors corresponding to each nozzle array of the recording head 234. A supply unit 224 supplies ink of each color from ink cartridges 210 for each color via a supply tube 236 of each color to the sub tanks 235.

There is provided a sheet feeding section from which sheets of paper 242 stacked on a sheet stacker (or a pressure plate) 241 of a sheet feed tray 202 are conveyed. The sheet feeding section includes a sheet feed roller or a semilunar roller 243 to separate and feed each sheet 242 from the sheet stacker 241 one by one and a separation pad 244 facing the sheet feed roller 243. The separation pad 244 is pressed against the sheet feed roller 243. The separation pad 244 is pressed against the sheet feed roller 243.

In order to send the sheet 242 fed from the sheet feed section to the lower side of the recording heads 234, a guide member 245 to guide the sheet 242, a counter roller 246, a conveyance guide member 247, and a pressing member 248 having an end press roller 249 are provided. Further, a conveyance belt 251 serving as a conveyance means to electrostatically attract and convey the sheet 242 to a position opposed to the recording heads 234 is provided.

This conveyance belt 251 is an endless belt stretching around a conveyance roller 252 and a tension roller 253, and is so configured as to rotate in a belt conveyance direction (i.e., a sub-scanning direction). In addition, a charging roller 256, which is a charging means to charge a surface of the conveyance belt 251, is provided. The charging miler 256 is disposed in contact with the surface layer of the conveyance belt 251 and is rotated driven by the rotation of the conveyance belt 251. The conveyance belt 251 is rotated in a belt conveyance direction by the rotation of the conveyance roller 252 driven by a sub-scanning motor, not shown.

Further, as a sheet ejection portion to eject the sheet 242 on which an image has been recorded by the recording heads 234, a separation claw 261 to separate each sheet 242 from the conveyance belt 251, sheet discharge rollers 262, 263, are disposed. A sheet discharge tray 203 is provided underneath the sheet discharge miler 262.

A duplex unit 271 is detachably provided at a backside of the apparatus body. This duplex unit 271 pulls in a sheet 242 which has been returned by a reverse rotation of the conveyance belt 251, reverses the sheet 242, and feeds the reversed sheet 242 again between the counter roller 246 and the conveyance belt 251. Further, an upper surface of the duplex unit 271 is used as a manual sheet feed tray 272.

Further, a maintenance unit 281 to maintain the nozzles of the recording heads 234 in good condition is provided at a non-print area at one side in the scanning direction of the carriage 233. The maintenance unit 281 includes caps 282*a*, 282*b* to cap each nozzle surface of the recording heads 234. The maintenance unit 281 further includes a wiper member 283 to wipe the nozzle surface. The maintenance unit 281 further includes a first dummy discharge receiver 284 to receive dummy-discharged droplets. The dummy discharge means a discharge of droplets to discharge agglomerated ink not contributive to a normal recording operation.

A second dummy-discharge receiver 288 is disposed at a non-print area at an opposite side in the scanning direction of the carriage 233. The second dummy-discharge receiver 288 receives droplets agglomerated during printing operation. The second dummy-discharge receiver 288 includes an opening 289 along the nozzle array direction of the recording head 234.

In the thus-configured image forming apparatus, the sheets 242 are separated and fed one by one from the sheet feed tray 202, the sheet 242 fed upward in a substantially vertical direction is guided by the guide member 245, and is conveyed while being sandwiched between the conveyance belt 251 and a counter roller 246. Further, a leading edge of the sheet 242 is guided by the conveyance guide member 247 and is pressed against the conveyance belt 251 by the end press roller 249 to thus change the conveyance direction by approximately 90 degrees.

When the sheet 242 is fed on the charged conveyance belt 251, the sheet 242 is attracted to the conveyance belt 251 and is conveyed in the sub-scanning direction by the cyclic rotation of the conveyance belt 251.

Then, the recording head 234 is driven in response to image signals, while moving the carriage 233, to allow the head 234 to discharge ink droplets onto the stopped sheet 242 to record a single line. After the sheet 242 is conveyed by a predetermined amount, a next line is recorded. Upon receiving a recording end signal or a signal indicating that a trailing edge of the sheet 242 has reached the recording area, the recording operation is terminated and the sheet 242 is ejected to the sheet discharge tray 203.

As a result, because the image forming apparatus includes the droplet discharge head according to preferred embodiments of the present invention, a high quality image is consistently formed.

In the present application, the term "sheet" is not limited to paper materials, but also includes an OHP sheet, fabrics, glass, board, and the like, on which ink droplets or other liquid can be adhered. The term "sheet" includes a recorded medium, recording medium, recording sheet, and the like. The term "image formation" means not only recording, but also printing, image printing, and the like.

The term "image forming apparatus" means an apparatus to perform image formation by impacting ink droplets to various media such as paper, thread, fiber, fabric, leather, metals, plastics, glass, wood, ceramics, and the like. "Image formation" means not only forming images with letters or figures having meaning to the medium, but also forming images without meaning such as patterns to the medium (and simply impacting the droplets to the medium).

The term "ink" is not limited to so-called ink, but is used as an inclusive term for every liquid such as recording liquid, fixing liquid, and aqueous fluid to be used for image formation, which further includes, for example, DNA samples, registration and pattern materials, and resins. For example, DNA samples, light-sensitive film, pattern material, and resins are included.

The term "image" is not limited to a plane two-dimensional one, but also includes a three-dimensional one, and the image formed by three-dimensionally from the 3D figure itself.

Further, the image forming apparatus includes, unless otherwise limited in particular, either of a serial-type image forming apparatus and a line-type image forming apparatus.

Additional modifications and variations of the present invention are possible in light of the above teachings. It is therefore to be understood that, within the scope of the appended claims, the invention may be practiced other than as specifically described herein.

Additional modifications and variations of the present invention are possible in light of the above teachings. It is therefore to be understood that, within the scope of the appended claims, the invention may be practiced other than as specifically described herein.

What is claimed is:

1. A droplet discharge head comprising:

a nozzle substrate containing a plurality of nozzles to discharge droplets;

a channel substrate to form a plurality of individual liquid chambers to which the plurality of nozzles communicate;

a common liquid chamber member, comprising a wall, to form a common liquid chamber to supply liquid to the plurality of individual liquid chambers;

a wall member to form a deformable damper area on a part of the wall of the common liquid chamber member, wherein the channel substrate and the common liquid chamber member are laminated together with the wall member sandwiched in between, and the channel substrate includes a concave-shaped damper chamber corresponding to the damper area; and a plurality of support pillars disposed on a concave-shaped bottom of the damper chamber, the support pillar connecting to the wall.

2. The droplet discharge head as claimed in claim 1, further comprising a plurality of channels through which air passes, wherein the support pillar is a wall disposed on the wall of the damper chamber in a direction perpendicular to a nozzle alignment direction; and the channels disposed on the wall allows the damper chamber to be exposed to external air.

3. The droplet discharge head as claimed in claim 2, comprising a plurality of walls disposed in the nozzle alignment direction, wherein the channels between adjacent walls are disposed at different positions in the direction perpendicular to the nozzle alignment direction.

4. The droplet discharge head as claimed in claim 2, comprising a plurality of walls disposed in the nozzle alignment direction, the plurality of walls including at least two walls having a different width in the nozzle alignment direction.

5. The droplet discharge head as claimed in claim 1, wherein the damper area comprises a plurality of ribs along the nozzle alignment direction and in a direction perpendicular to the nozzle alignment direction; and the support pillars inside the damper chamber are disposed at positions corresponding to positions of the ribs of the damper area.

6. The droplet discharge head as claimed in claim 5, wherein a width of the support pillars in the nozzle alignment direction is larger than a width of the rib in the nozzle alignment direction.

7. The droplet discharge head as claimed in claim 1, wherein the damper chamber is exposed to external air.

8. The droplet discharge head as claimed in claim 1, wherein concave portions are formed on a side of a nozzle surface of the nozzle substrate and in areas corresponding to areas between the support pillars in the nozzle alignment direction.

9. The droplet discharge head as claimed in claim 8, wherein the concave portion is curved toward a bottom of the damper chamber.

10. An image forming apparatus comprising the droplet discharge head as claimed in claim 1.

* * * * *